US006536365B1

(12) United States Patent
Horton

(10) Patent No.: US 6,536,365 B1
(45) Date of Patent: Mar. 25, 2003

(54) SHOCK-MITIGATING NOSE FOR UNDERWATER VEHICLES

(75) Inventor: Duane M. Horton, Portsmouth, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/066,490

(22) Filed: Feb. 1, 2002

(51) Int. Cl.[7] ..... B63B 21/66

(52) U.S. Cl. ..... 114/244; 114/20.1; 114/238; 114/316; 114/317; 114/318; 114/319; 114/320; 114/249; 114/254; 114/253; 43/41; 43/42.22; 43/42.24; 43/42.35; 43/42.48

(58) Field of Search ..... 114/20.1, 238, 114/316, 317, 318, 319, 320, 244, 249, 254, 253; 43/41, 42.22, 42.24, 42.35, 42.48

(56) References Cited

U.S. PATENT DOCUMENTS

| | | | | | |
|---|---|---|---|---|---|
| 1,130,585 | A | * | 3/1915 | Durr | 114/20.1 |
| 1,292,618 | A | * | 1/1919 | Lazelle | 446/159 |
| 2,164,340 | A | * | 7/1939 | Morgan et al. | 102/334 |
| 2,371,404 | A | * | 3/1945 | Mumford | 114/244 |
| 2,439,123 | A | * | 4/1948 | Bell | 43/41 |
| 3,054,618 | A | * | 9/1962 | Abrams et al. | 102/422 |
| 3,180,225 | A | * | 4/1965 | Draim | 102/399 |
| 3,279,405 | A | * | 10/1966 | Billmeyer | 102/390 |
| 3,372,662 | A | * | 3/1968 | Nisewanger | 114/20.1 |
| 3,648,643 | A | * | 3/1972 | Murray | 114/382 |
| 3,805,729 | A | * | 4/1974 | Golay et al. | 114/244 |
| 3,916,556 | A | * | 11/1975 | Armanno | 43/42.06 |
| 4,549,464 | A | * | 10/1985 | Hawkins et al. | 102/293 |
| 4,593,637 | A | * | 6/1986 | Klee | 102/293 |
| 4,649,744 | A | * | 3/1987 | Cotillier | 73/170.34 |
| 4,686,927 | A | * | 8/1987 | Hawkes et al. | 104/173.1 |
| 4,918,854 | A | * | 4/1990 | Webre, Jr. | 43/42.31 |
| 5,050,525 | A | * | 9/1991 | Lee et al. | 114/244 |
| 5,092,222 | A | * | 3/1992 | Lynch | 89/1.809 |
| 5,235,928 | A | * | 8/1993 | Shank, Jr. | 114/244 |
| 5,276,992 | A | * | 1/1994 | Kato | 43/42.06 |
| 5,983,821 | A | * | 11/1999 | Williams | 114/244 |
| 6,146,114 | A | * | 11/2000 | Nardacci et al. | 417/437 |

FOREIGN PATENT DOCUMENTS

| | | | |
|---|---|---|---|
| DE | 003931825 A1 | * | 6/1993 |
| GB | 2010764 A | * | 7/1979 |
| WO | WO 81/00186 | * | 2/1981 |

* cited by examiner

*Primary Examiner*—Michael J. Carone
*Assistant Examiner*—John Richardson
(74) *Attorney, Agent, or Firm*—James M. Kasischke; Michael F. Oglo; Jean-Paul Nasser

(57) ABSTRACT

A flexible nose assembly for an underwater vehicle provides increased energy-absorbing capabilities and facilitates recovery and handling of the vehicle. The flexible nose assembly includes a flexible nose cap, at least one retrieval device, and at least one cable that is strong in tension, yet weak in compression which is coupled between the retrieval device and the UUV body. The flexible nose cap has a gap formed therein allowing the communication of environmental water into the region between the vehicle body and the nose cap. Optionally, the retrieval device may be recessed into the flexible nose assembly, thereby reducing hydrodynamic drag and overall vehicle length. Energy-absorbing ballast can be positioned within the nose cap in order to further enhance survivability.

10 Claims, 1 Drawing Sheet

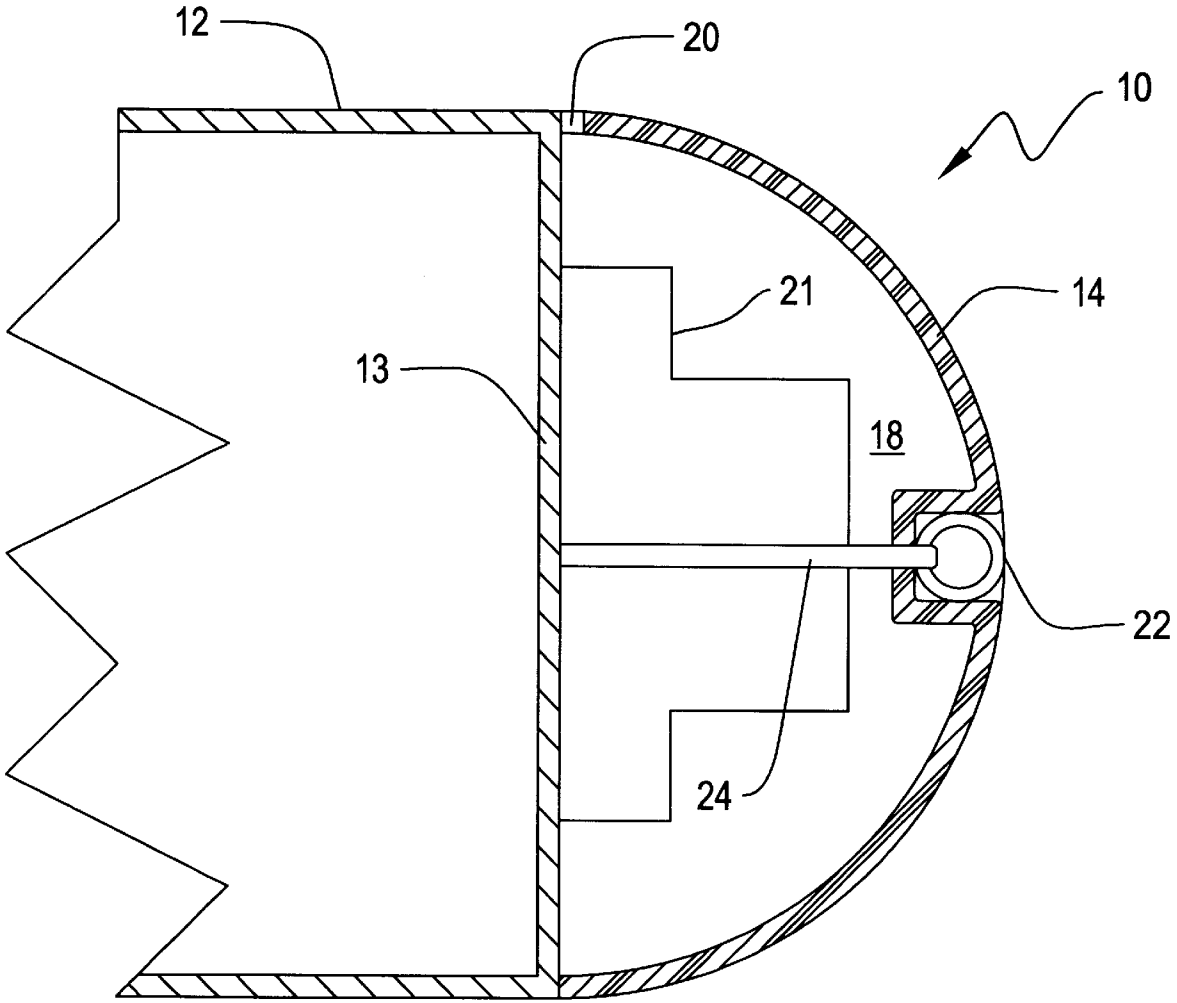
FIG.

SHOCK-MITIGATING NOSE FOR UNDERWATER VEHICLES

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

Not applicable.

BACKGROUND OF THE INVENTION

1. Field of the Invention

This invention relates to underwater vehicle noses, and more particularly, to an unmanned underwater vehicle nose having an improved ability to withstand high-shock conditions resulting from collisions.

2. Description of the Prior Art

Unmanned underwater vehicles (UUVs) perform a wide range of missions and come in many shapes and sizes, and generally consist of several sections, attached to one another by various means. Some UUVs have one or more flooded sections, inside of which oceanographic sensors and other hardware may be mounted. Owing to their size and complexity, UUVs must be handled, launched and recovered with great care. Typically, the UUV has one or more recovery fittings which allow it to be snagged and lifted onto a recovering vessel. The nose of the UUV is often the preferred location for such a recovery fitting because the nose is a low-flow area.

UUVs are also susceptible to catastrophic loss upon collisions with objects. Since UUVs travel mostly in a forward direction, their noses are the most likely section to inadvertently strike a submerged object, such as a rock, ship, submarine, launch and recovery craft, buoy, or aquatic creature. Even low-speed collisions can cause a UUV's high-strength, yet often brittle, hull sections to crack or become misaligned, creating leak paths by which water can flood and sink the UUV.

It is known to provide UUVs, such as torpedoes and other vehicles, with frangible nose caps. These nose caps are usually designed in a manner that allows them to break away upon impact with the water in order to expose sensors or other equipment contained within the nose caps to the outside environment.

One problem with flexible nose caps is that they don't make any provision for recovering the UUV. A recovery fitting cannot be positioned on the flexible nose cap itself because the nose cap isn't strong enough to support lifting of the vehicle.

What is needed, however, is a feature for a UUV that provides increased collision protection for the UUV but at the same time allows normal recovery of the UUV.

SUMMARY OF THE INVENTION

It is an object of the present invention to provide a UUV having improved survivability after collision.

Another object of the present invention is to provide a UUV having a flexible nose cap that allows lifting by the nose cap.

Yet another object of the invention is to provide a UUV having these features that is easy to construct and cost-effective to produce.

Accordingly, the current invention provides an unmanned undersea vehicle having a flexible nose assembly. A flexible nose cap defines a hollow region therein and having a gap formed in the cap allowing fluid communication with environmental water. The flexible nose cap is joined to a bulkhead of the unmanned undersea vehicle body. At least one retrieval device is positioned on the flexible nose cap where it is accessible from the exterior of the flexible nose cap. A cable is attached between the retrieval device and the bulkhead. The invention can also include a recessed section in the nose cap having said retrieval device positioned therein.

Other objects, advantages and novel features of the invention will become apparent from the following detailed description of the invention when considered in conjunction with the accompanying drawing.

BRIEF DESCRIPTION OF THE DRAWINGS

These and other features and advantages of the present invention will be better understood in view of the following description of the invention taken together with the drawings wherein:

The sole FIG. is a cutaway view of the flexible nose cap of the present invention.

DESCRIPTION OF THE PREFERRED EMBODIMENT

A UUV with a flexible nose assembly 10 is shown in the FIG. as a UUV body 12 coupled to a flexible nose cap 14. The nose cap 14 defines a hollow region 18 between nose cap 14 and body 12. Nose cap 14 is mounted to a bulkhead 13 positioned at the forward end of body 12. Nose cap 14 can be attached to bulkhead 13 by bolts passing through the outer perimeter of nose cap 14 into bosses along the circumference of bulkhead 13. The nose cap 14 is constructed out of metal, plastics, synthetics, rubbers (such as, but not limited to, vulcanized rubber), composites, or any other material having sufficient structural rigidity to sustain the forces generated during normal use. When subjected to minor collisions such as launch forces, minor impacts and vehicle handling, the nose cap 14 should elastically deform and return to its original shape on removal of the collision force. In cases of major collision, the nose cap 14 should absorb energy by elastic and plastic deformation in order to protect body 12 from cracking or misalignment of adjoining sections because either of these conditions can result in leakage and subsequent catastrophic loss.

The hollow region 18 is shown filled with water and is in fluid communication with the body of water via a slight gap 20. Gap 20 provides pressure equalization with the surrounding fluid environment. Hardware 21 can be positioned within hollow region 18. Hardware 21 can include ballast and/or instrumentation such as transducers and environmental sensors. Ballast, typically made from lead, can be configured in a cellular form to act as a shock-absorbing element. When a severe impact occurs to nose cap 14 and contact is made with hardware 21, ballast as a part of hardware 21 will deform and absorb energy from the impact. Hardware 21 should be mounted to bulkhead 13 in order to prevent damage or dislocation of hardware 21 during minor impacts.

The flexible nose assembly 10 also contains at least one retrieval device 22 that may be positioned outside of the flexible nose cap 14. In a preferred embodiment, the retrieval device 22 is recessed into the flexible nose cap 14. The retrieval device 22 is secured to the bulkhead 13 via at least one cable 24. The cable 24 is designed to be strong in tension, yet weak in compression. This feature facilitates recovery and handling of the UUV, without decreasing the nose assembly's 10 ability to absorb energy during an impact and without transmitting impact shock to body 12. The retrieval device 22 may be any commonly used retaining device such as, but not limited to, a ring, a cleat, a hook, or a clip.

In light of the above, it is therefore understood that within the scope of the appended claims, the invention may be practiced otherwise than as specifically described.

What is claimed is:

1. A flexible nose assembly for use with an undersea vehicle comprising:

a flexible nose cap defining a hollow region within said flexible nose cap, said hollow region filled with environmental water;

at least one retrieval device accessible in said flexible nose section; and at least one cable attached to said retrieval device and said undersea vehicle body;

said flexible nose cap having a recessed section with said retrieval device being positioned therein.

2. The assembly of claim 1 wherein said flexible nose cap has a gap formed therein allowing communication therethough.

3. The assembly of claim 1 wherein said retrieval device is selected from the-group consisting of a ring, a hook, a cleat, and a clip.

4. A flexible nose assembly for use with an unmanned undersea vehicle body in a body of water comprising:

a flexible nose cap defining a hollow region therein and having a gap formed in said cap allowing communication with said body of water, said flexible nose cap being joinable to a bulkhead of said unmanned undersea vehicle body;

at least one retrieval device positioned on said flexible nose cap accessible from the exterior of said flexible nose cap; and at least one cable attached to said retrieval device and to a bulkhead of said unmanned undersea vehicle body.

5. The assembly of claim 4 wherein said flexible nose cap further includes a recessed section having said retrieval device positioned therein.

6. The assembly of claim 4 wherein said retrieval device is selected from the group consisting of a ring, a hook, a cleat, and a clip.

7. The assembly of claim 4 further comprising energy-absorbing ballast positioned within said flexible nose cap hollow region for absorbing the energy of severe impacts.

8. An impact-resistant unmanned undersea vehicle having:

a gas-filled hull having a bulkhead located at its forward end;

a flexible nose cap joined to said hull, defining a hollow region therein and having a gap formed in said cap allowing communication of environmental fluid into said hollow region;

at least one cable joined to said hull at said bulkhead; and at least one retrieval device joined to said at least one cable and positioned on said flexible nose cap at a location accessible from the exterior of said flexible nose cap.

9. The device of claim 8 wherein said flexible nose cap has a recess formed in an exterior thereof and said at least one retrieval device is positioned in said recess.

10. The device of claim 8 further comprising energy-absorbing ballast positioned within said flexible nose cap hollow region for absorbing the energy of severe impacts.

* * * * *